US008523479B2

(12) United States Patent
Adler et al.

(10) Patent No.: US 8,523,479 B2
(45) Date of Patent: Sep. 3, 2013

(54) SURFACE MOUNT VEHICLE ANTI-RAM SECURITY SYSTEMS

(75) Inventors: Richard Steven Adler, Upland, CA (US); John Crawford, Burbank, CA (US)

(73) Assignee: RSA Protective Technology, LLC, Upland, CA (US)

( * ) Notice: Subject to any disclaimer, the term of this patent is extended or adjusted under 35 U.S.C. 154(b) by 0 days.

(21) Appl. No.: 13/607,935

(22) Filed: Sep. 10, 2012

(65) Prior Publication Data

US 2013/0034387 A1 Feb. 7, 2013

Related U.S. Application Data

(63) Continuation of application No. 12/779,011, filed on May 12, 2010, now Pat. No. 8,277,143.

(60) Provisional application No. 61/216,099, filed on May 12, 2009, provisional application No. 61/280,452, filed on Nov. 3, 2009, provisional application No. 61/283,471, filed on Dec. 3, 2009, provisional application No. 61/284,504, filed on Dec. 16, 2009, provisional application No. 61/341,563, filed on Apr. 1, 2010.

(51) Int. Cl.
*E01F 15/00* (2006.01)

(52) U.S. Cl.
USPC ..... 404/6; 256/13.1

(58) Field of Classification Search
USPC ..... 404/6, 9, 10; 256/1, 13.1
See application file for complete search history.

(56) References Cited

U.S. PATENT DOCUMENTS 1,449,518 A 3/1923 Lawson
1,969,845 A 8/1934 Hick (Continued)

FOREIGN PATENT DOCUMENTS

DE 34 12354 10/1985
DE 4004851 2/1990

(Continued)

OTHER PUBLICATIONS http://web.archive.org/web/20020525043057/http://globalsecurity.org/military/library...dated Feb. 12, 2007, 9 pgs.

(Continued)

*Primary Examiner* — Raymond W Addie
(74) *Attorney, Agent, or Firm* — Frank J. DeRosa; Frommer Lawrence & Haug LLP

(57) ABSTRACT

Disclosed anti-ram systems comprise at least one bollard section comprising a base of limited height and a plurality of spaced bollards extending upwardly from the base, which may be erected or installed on a paved surface such as asphalt, concrete, paver stones, etc., or on an unpaved surface such as soil, and need not be partially of fully buried, and yet can qualify for Department of State crash ratings previously assigned to buried bollard systems. Disclosed anti-ram systems also comprise a plurality of bollard sections and one or more connectors for interconnecting two or more of the bollard sections, and may also include an anchor or anchor system engaging at least each end of a bollard section not connected to another bollard section. The bollard sections may be filled with ballast and high friction structure may be attached to the bottom of the bollard sections to resist sliding after impact.

21 Claims, 13 Drawing Sheets

(56) References Cited

U.S. PATENT DOCUMENTS

| | | | | |
|---|---|---|---|---|
| 2,958,926 | A | 11/1960 | Morison | |
| 4,828,424 | A | 5/1989 | Crisp | |
| 6,367,208 | B1 | 4/2002 | Campbell | |
| 6,454,488 | B1 | 9/2002 | Lewis, Sr. et al. | |
| 6,702,512 | B1 | 3/2004 | Reale | |
| 6,805,515 | B2 | 10/2004 | Reale | |
| 7,441,751 | B1 * | 10/2008 | Gibbs | 256/23 |
| 2003/0127636 | A1 | 7/2003 | Piron | |
| 2004/0033106 | A1 | 2/2004 | Turpin | |
| 2004/0067104 | A1 | 4/2004 | Venegas | |
| 2004/0190990 | A1 | 9/2004 | Blair | |
| 2005/0201829 | A1 | 9/2005 | Dehart | |
| 2006/0090408 | A1 | 5/2006 | Darcy | |
| 2008/0038056 | A1 | 2/2008 | Patel | |
| 2008/0112756 | A1 * | 5/2008 | Omar | 404/9 |
| 2008/0122756 | A1 | 5/2008 | Kawasaki et al. | |
| 2008/0205982 | A1 * | 8/2008 | Hubbell | 404/6 |
| 2009/0250674 | A1 | 10/2009 | Darcy | |
| 2010/0219390 | A1 * | 9/2010 | O'Banion et al. | 256/1 |

FOREIGN PATENT DOCUMENTS

| | | |
|---|---|---|
| EP | 0009235 | 4/1980 |
| EP | 0 955 414 | 11/1999 |
| EP | 1 054 108 | 11/2000 |
| EP | 1 479 826 | 11/2004 |
| FR | 2.057.107 | 4/1971 |
| GB | 2 229 472 | 9/1990 |
| GB | 2 194 577 | 3/1998 |
| JP | 10176314 | 6/1998 |
| JP | 11061746 | 3/1999 |
| JP | 2001295298 | 10/2001 |
| WO | WO 02/081824 | 10/2002 |

OTHER PUBLICATIONS

Department of Defense Handbook, "Selection and Application of Vehicle Barriers" MIL-DDBK-1013/14, Feb. 1, 1999.

* cited by examiner

SURFACE MOUNT VEHICLE ANTI-RAM SECURITY SYSTEMS

RELATED APPLICATIONS

This application is a continuation of Ser. No. 12/779,011, filed May 12, 2010, now U.S. Pat. Ser. No. 8,277,143 B2 titled "Surface Mount Vehicle Anti-Ram Security Systems," the entire disclosure of which is incorporated herein by reference.

This application claims the priority of the following US provisional patent applications:

61/216,099, filed May 12, 2009, titled "Surface Mount Bollards with Multiple Configurations," the entire disclosure of which is incorporated herein by reference;

61/280,452, filed Nov. 3, 2009, titled "Surface Mount Bollards K12," the entire disclosure of which is incorporated herein by reference;

61/283,471, filed Dec. 3, 2009, titled "K12 Surface Mount Bollards with Anti-Scaling Fence and Blast Walls," the entire disclosure of which is incorporated herein by reference;

61/284,504, filed Dec. 16, 2009, titled "Surface Mount Anti-Ram Anti-Scaling Anti-Blast Modular System—Perimeter Force Protection," the entire disclosure of which is incorporated herein by reference; and 61/341,563, filed Apr. 1, 2010, titled "Re-configurable, Surface Mounted High Security Anti-Ram Beam and Sensored Fence System," the entire disclosure of which is incorporated herein by reference.

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all copyrights whatsoever.

BACKGROUND OF THE INVENTION

The invention disclosed herein relates generally to the field of perimeter security and barrier and/or anti-ram (referred to below simply as "anti-ram") devices and systems which, e.g., protect against vehicle penetration or channel vehicle traffic, etc. In particular, embodiments of the invention relate to vehicle anti-ram systems that can be mounted on existing or partially or entirely prepared surfaces. Embodiments of the invention can be mounted on existing surfaces such as streets, sidewalks and soil without any or with minimal site preparation, although the same or similar embodiments or variations may also be installed in sites which involve site preparation or construction associated with installation and/or operation of one or more embodiments. According to some embodiments, such anti-ram systems comprise one or more bollards.

SUMMARY OF THE INVENTION

Anti-ram systems according to embodiments of the invention comprise at least one bollard section comprising a base of limited height and a plurality of spaced bollards extending upwardly from the base. According to embodiments of the invention, an anti-ram system may be erected or installed on a paved surface such as asphalt, concrete, paver stones, etc., or on an unpaved surface such as soil. According to some embodiments, anti-ram systems are readily adaptable to different terrain and installation requirements, e.g., installation on slopes, and in various angular configurations. According to some embodiments, an anti-ram system can be installed with no or little site preparation, and/or can be installed without excavation, e.g., on an existing or prepared surface.

According to some embodiments, an anti-ram system comprises a plurality of bollard sections and one or more connectors for interconnecting two or more of the bollard sections.

According to some embodiments, an anti-ram system comprises an anchor or anchor system engaging at least each end of a bollard section not connected to another bollard section. (Use of the term anchor herein encompasses an anchor system unless the context indicates otherwise.)

According to some embodiments, a system comprises high friction structure secured to a bollard section or sections and/or to a connector or connectors to inhibit sliding of the system after an impact.

According to various embodiments of the invention, an anti-ram system after impact may move a certain distance, referred to as a "stopping distance." An anti-ram system according to embodiments of the invention may provide an acceptable stopping distance on a paved or unpaved surface, e.g., from 3 to 50 feet depending upon Department of State (DOS) and ASTM ratings. Factors that can affect the stopping distance include system weight, bollard height, on-center bollard spacing, anchoring, friction and configuration.

DOS and ASTM crash ratings for shallow and deep mount bollard systems, i.e., systems in which a bollard base and or a lower portion of a bollard, involve bollard on-center spacing of not more than 4' and bollard heights of about 36"-40". Some of the embodiments of the surface mount of anti-ram system disclosed herein including such bollard spacing and heights.

As mentioned, embodiments of the invention may comprise one or more bollard sections. For example: an anti-ram system comprising one bollard section includes an anchor for each end of the section; an anti-ram system comprising two bollard sections comprises a connector for interconnecting adjacent ends of the two sections and an anchor for each unconnected end of the two interconnected sections; and an anti-ram system comprising three bases comprises two connectors for interconnecting adjacent ends of two of the bollard sections, and an anchor for each unconnected end of the interconnected sections. However, according to some embodiments, an anti-ram system does not include two or any anchors.

Embodiments of anti-ram systems of considerable length, or in particular configurations, may in some applications not require an anchor or anchors, or high friction measures, etc. In such embodiments, there may be sufficient weight without anchors and/or without ballast to stop a vehicle within a desired stopping distance. For example, if the length of a system is long enough, then for a vehicle strike in the center, anchors would not be needed. The overall mass of the system may be enough to hold back the vehicle from vaulting or exceeding the desired penetration distance. In some applications, the system can be wider, or higher, etc. In some applications, e.g., in a war zone, an anti-ram system can be positioned a substantial distance from a site to be protected, e.g., temporary barracks, as opposed to an urban environment where there is a short distance fro the street to a building.

According to some embodiments, an anchor comprises deadman-type (which term encompasses deadweight-type structures) structure, e.g., a fabricated or assembled structure such as a concrete or stone block, or a container (e.g., a hollow steel box) filled with ballast, or an available structure such as a vehicle, etc. Examples of ballast include locally available or easily transportable bulk material such as sand, soil, stone, marbles, concrete, water, combinations thereof, etc. According to some embodiments, a base or bases may be anchored to non-made structure that is secured to the ground such as building walls or foundations, or to naturally occurring or man-made earthen or ground structures such as rock formations, berms, trees, walls or curbs, or to bollards or barriers that are installed in shallow or deep mount constructions, etc. According to some embodiments, anchors comprise imbedded structures such as footers which can be positioned behind a base (i.e., opposite a side of expected impact), or below a base with structure embedded for bolting the base to the anchor, or extending through or into a hole in the base, etc. According to some embodiments, anchors may comprise spikes or members that pass through a base and penetrate a paved or unpaved surface. According to some embodiments, an anti-ram system comprises an anchor system, which can comprise suitable anchors described above and/or a cable extending from at least one end of a base, or through a base or bollard section to an anchor such as a building, permanent bollard system, etc. In some embodiments, a post-tensioning system including a cable passing through at least one base or bollard section can be used to assist in interconnecting bollard sections into an integral system. In one embodiment, a conduit is positioned running lengthwise through each or selected bases, and a cable is run through the conduit or conduits and post-tensioned. This can be done for the entire system or portions thereof to increase the stopping power of the system or portions thereof.

An anti-ram system according to some embodiments can be installed over uneven surfaces such as extending over a curb. In such embodiments, portions of the system contacting the curb receive an increase in the friction force, which compensates for some or all of a base not contacting the curb or the street below. In some embodiments, a connector is provided for bollard sections on a street and on a curb.

According to some embodiments, a base or bases can be fully or partially below grade in a space or excavation, etc., e.g., partially or fully buried, etc., as a permanent or temporary installation.

Adjacent bollard sections of an anti-ram system according to various embodiments of the invention may be interconnected at various angles such that an anti-ram system may extend along a straight line, or along lines at 90° or 45°, or other angles to each other, or along curved lines. Various connectors are provided in accordance with embodiments of the invention to achieve various system configurations.

Connectors according to some embodiments of the invention interconnect two adjacent bollard sections and engage at least one bollard extending from each base of the two interconnected sections, e.g., a bollard passes through a hole in the connector. Such engagement produces a locking effect between and among bollard sections that has the effect of an integral base formed of individual base units. As a result, the interconnected bollard sections cooperate to resist an impact This assists in causing an anti-ram system with locked bollard sections to react as a unit to an impact, rather than just the impacted bollard section reacting. This brings aspects of the overall anti-ram system to bear against an impact, including non-impacted bases and anchors.

According to some embodiments, tabs, stubs or keyed structures may be provided on adjacent interconnected bases which are engaged by a connector interconnecting the adjacent bases. According to some embodiments, a tab may comprise a bollard stub, e.g., constructed similar to a bollard but with a height only sufficient to engage a hole or receptacle in a connector. Engagement of a connector with a base via a bollard and another structure such as a tab, stub or key, assists in stabilizing and strengthening connection of bollard sections.

According to some embodiments, a connector may include sides projecting downward along the front and back which in some embodiments extend to the front and back sides of adjacent bases and aid in the securing of the connector. Such connectors may form an enclosure similar to a base. In some embodiments, a connector may be secured by fasteners to a base or bases. In some embodiments, a connector includes one or more bollards secured thereto.

A base may be constructed of any suitable material, preferably steel, and in any suitable configuration, size and weight. Bases of various weights can be constructed. The weight of a base depends upon factors including size, materials, construction, whether a base is ballasted and if so, the ballast. According to some embodiments, ballast such as that described above may be provided. Considerations in determining the weight of bases include portability, installability and stopping distance. Various applications may involve tradeoffs, e.g., lighter weight for portability (especially by air or to remote locations) where a longer stopping distance can be tolerated. Also, weight can be increased for a particular anti-ram system comprising given bases but with heavier deadman anchors, particularly ballasted deadman anchors. According to some embodiments, bases are constructed according to a limited number of pre-set designs, each suitable for a range of applications. According to some embodiments, bases may be specially constructed for a particular application.

According to some embodiments, a base forms a closed enclosure, and one or more openings are provided for ballast to be introduced. In these embodiments, the ballast is of a size to pass through the opening(s). According to some embodiments, a base forms an open enclosure. In these embodiments, larger size ballast may be used, and granular ballast such as sand, soil, crushed stone, concrete, etc., may be used as filler. According to some embodiments, an anti-ram system comprises deadman anchors at locations in addition the ends of the system to increase the overall weight of the system.

According to some embodiments, a base or bases may be installed angled front to rear into an unpaved surface to decrease the stopping distance compared to the base(s) being flat on the surface.

The overall weight of a bollard section depends not only upon the weight of the base but also upon the weight of the bollards. According to embodiments of the invention, the weight of a bollard section can be increased or decreased by the particular diameter (cross-section) and height of the bollards, and the material of which the bollard is made, and whether the bollard is ballasted or not.

According to some embodiments, the height of a base depends upon, e. g., desired weight, portability and installability and site conditions regarding passage through the base. According to one embodiment, the height of a base is generally the height of a step, e.g., about 7 or 8 inches. However, the height could be more or less depending upon site requirements or preferences and the desired weight of a base.

Base size depends upon factors including weight, portability, performance, stopping distance and site considerations. According to some embodiments, the width of a base is such as to resist tipping and sliding of the base upon impact, and to assist in providing a desired weight. According to some embodiments, the length of a base is sufficient to accommodate at least two bollards, which, according to some embodiments, are spaced about 3 feet to about 5 feet apart, and either a connector or anchor at each end. According to some embodiments, the length of a base is such as to resist sliding of the base upon impact, to assist in providing a desired weight and portability.

A bollard can be secured to a base in any suitable manner. Considerations in determining securement of a bollard to a base comprise resistance to rotating or separating during impact and field installability. According to some embodiments, a bollard is secured to a base in a portion of the base reinforced by one or more structural members. According to some embodiments, a bollard is installed through a top in engagement therewith, e.g., through a hole in the top which is only slightly larger than the cross-section of the bollard or smaller than a ring or other engagement or stop structure on the bollard. According to some embodiments, a bollard is attached to a base with at least one fastener. According to some embodiments, a bollard is secured to a base with at least one weld.

According to some embodiments, e.g., for installation on hard or paved surfaces, a high friction structure comprises a mat or pad of high friction material, e.g., natural or synthetic rubber, secured to the bottom of a base and/or connector. According to some embodiments, e.g., for installation on unpaved surfaces such as soil, protrusions or spikes are attached to the bottom of a section to dig into the surface.

According to some embodiments, anti-ram devices and systems include structure to allow and/or facilitate passage therethrough of pedestrians including those using aids for the handicapped such as wheelchairs, walkers, etc., and for bicycles, carriages, etc., and for passage therethrough of vehicles upon a change in configuration, e.g., retracting or removing one or more bollards, or pivoting of a bollard section.

According to some embodiments, bollard sections are modular for portability and ease of installation and possible removal and reuse.

According to some embodiments, anti-ram devices and systems can be installed for temporary use, e.g., for temporary perimeter security next to buildings other structures, to temporarily close off areas, e.g., as storage areas, to separate roadways from pedestrian areas, for street closures, and for other uses. According to some embodiments, anti-ram devices and systems can be rapidly deployed, installed and removed for civilian and military applications.

According to some embodiments, an anti-ram system comprises modular bollard sections. According to some embodiments, the modular bollard sections comprise bollards and the system comprises modular connectors. According to some embodiments, such modular components are portable and are erected on site into an anti-ram system, and in some embodiments without field welding and/or bolting. According to some embodiments, modular components are fabricated from parts on site. According to these embodiments, the modular components are shipped or stored broken down and assembled on site. According to some embodiments, an anti-ram system erected from modular components can be disassembled for subsequent reuse.

According to some embodiments, spacers are provided to assist in erecting a modular anti-ram system. According to some embodiments, two bases are positioned with a spacer therebetween, which may be left in position later removed and replaced with a similarly configured modular connector.

An anti-ram system according to an embodiment of the invention comprises a plurality of bollard sections extending along a line or lines, each section comprising a base and a plurality of bollards secured to the base, one or more connectors, each connecting two bollard sections together at adjacent ends thereof along a line and an anchor engaging a bollard section at each end of the system, wherein each base comprises a bottom, sides and a top secured together to define an enclosure of limited height, e.g., in the approximate range of 4" to 18", each bollard of the plurality of bollards of a section extending from the enclosure upwardly from the bottom of the section through a hole in the top of the section.

As discussed above, the ant-ram system of claim 1 may comprise one or more of the following: ballast in the enclosure of one or more bollard sections; and high friction structure secured to a base of one or more bollard sections extending along the bottom thereof exterior to the enclosure.

According to an embodiment, at least one anchor of the anti-ram system comprises: a deadweight engaging a bollard section at an end of the system; and/or a part of a man-made structure anchored to the ground and engaging a bollard section at an end of the system; and/or a natural structure anchored to the ground and engaging a bollard section at an end of the system.

A connector for the anti-ram system may, according various embodiments, engage at least one bollard of a section the connector connects, and/or structure projecting from the top of a bollard section spaced from the engaged bollard. According to some embodiments such projecting structure may comprise a bollard stub secured to the base of the connected bollard section or key configured structure.

A connector for the anti-ram system may comprise according to some embodiments: a 180° connector including a top that extends over ends of two adjacent connected bollard sections; and/or a 45° connector including a top that extends over ends of two adjacent connected bollard sections. According to one embodiment, the 45° connector may comprise sides and a bottom which with a portion of the top define an enclosure, the connected bollard sections being spaced with the enclosure positioned in the space and portions of the top extending beyond the enclosure and over the ends of the two adjacent connected bollard sections. According to one embodiment, the enclosure of the 45° bollard may include ballast. According to one embodiment, the enclosure of the 45° bollard may include a bollard secured thereto extending from the connector enclosure upwardly from the bottom thereof through a hole in the top thereof.

According to one embodiment, a 180° connector includes a central lower portion and raised portions on each side of the central portion, the raised portions extending over ends of connected to adjacent bollard sections, the connector defining a lower region between the two connected bollard sections.

According to one embodiment, a 180° connector includes a lower portion and a raised, the raised portion extending over and connected to one of the two connected bollard sections whose top is at higher elevation than the top of another of the two connected bollard section, and the lower portion extending over and connected to the bollard section whose top is at an elevation lower than that of the one bollard section.

According to one embodiment, a 180° connector comprises a vehicle passage comprising at least one retractable or removable bollard, the connector being position between and connected to ends of the two connected bollard sections.

According to one embodiment, a connector comprises a bollard secured thereto, the connector being position between and connected to ends of the two connected bollard sections.

According to one embodiment, the enclosure comprises a flat bottom and a flat top.

BRIEF DESCRIPTION OF THE DRAWINGS

The invention is illustrated in the figures of the accompanying drawings, which are meant to be exemplary and not limiting, and in which like references are intended to refer to like or corresponding parts.

DETAILED DESCRIPTION OF PREFERRED EMBODIMENTS

Embodiments of the invention are described below with reference to the accompanying drawings which depict embodiments of anti-ram systems and components thereof. However, it is to be understood that the invention encompasses components and systems other than those illustrated. Also, the invention is not limited to the depicted embodiments and the details thereof, which are provided for purposes of illustration and not limitation.

Some embodiments require no site excavation or any physical connection to the ground or other structure. Some embodiments are intended to work equally well as an excavated and permanently cast in place anti-ram system. Some embodiments are modular, which allows quick deployment, installation and removal. For example, according to some embodiments, modular components can be fabricated off-site and air-lifted and/or trucked to the site ready for installation. According to some embodiments, ballast can be added off site and the bollards can be inserted off site as well. Fully prefabricated bollard sections can then be transported to the site. According to some embodiments of a modular system, like components are interchangeable, and various components mate and/or interlock, etc., with other components.

According to some embodiments of the invention, a moving vehicle can be stopped based on one or more of the following and other factors. The mass (weight) of the system, the deformation of system components, e.g., bollards, bases, anchors, and high friction measures to inhibit movement of components after impact. When a vehicle impacts a bollard of the system, because components of the system are interconnected, all or a substantial portion of the system resists displacement, and not only the section impacted, and more of the system than the impacted bollard and section are available for deformation.

Figure 1:
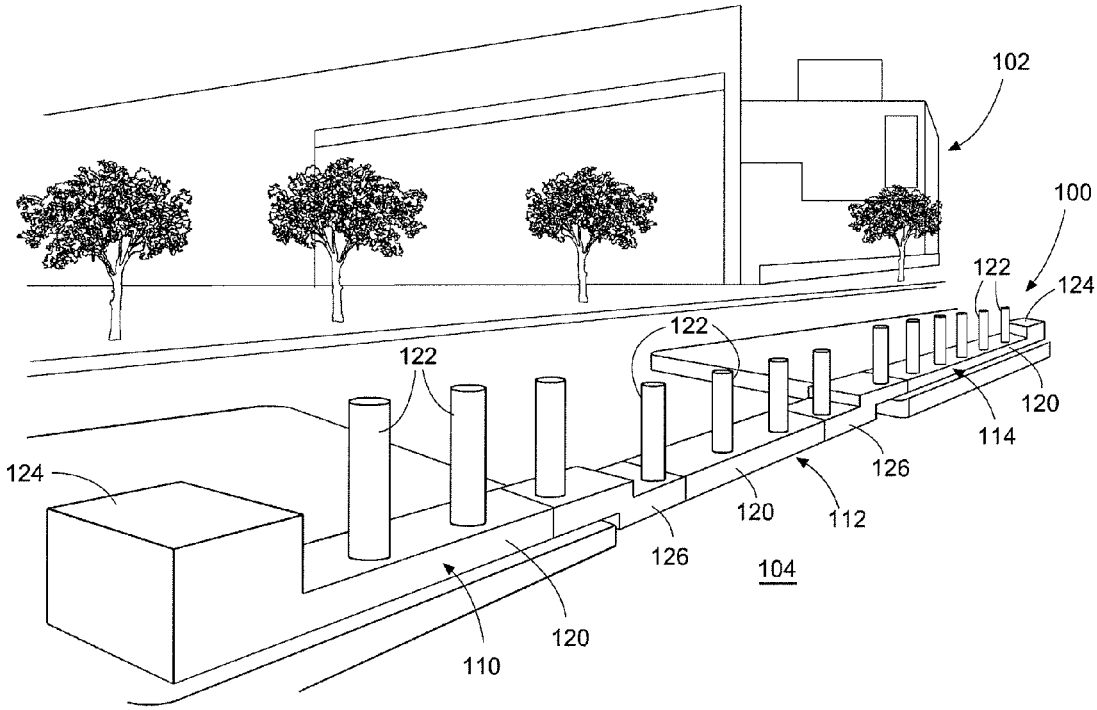
FIG. 1 is a rendering illustrating a vehicle anti-ram system according to an embodiment of the invention installed along the perimeter of a facility between a roadway and a building and an area adjacent the building.

Referring to FIG. 1, a vehicle anti-ram system 100 extends along a perimeter of a facility 102 between the facility and a roadway 104. The anti-ram system 100 includes three sections 110, 112 and 114. Each section comprises a base 120 and a plurality of bollards 122. The system 100 also includes anchors 124 in the form of deadmen at opposite ends of the system. The system also includes connectors 126 connecting the three sections together. Details of various embodiments of bollard sections, connectors and anchors are discussed below in connection with other figures.

Figure 2:
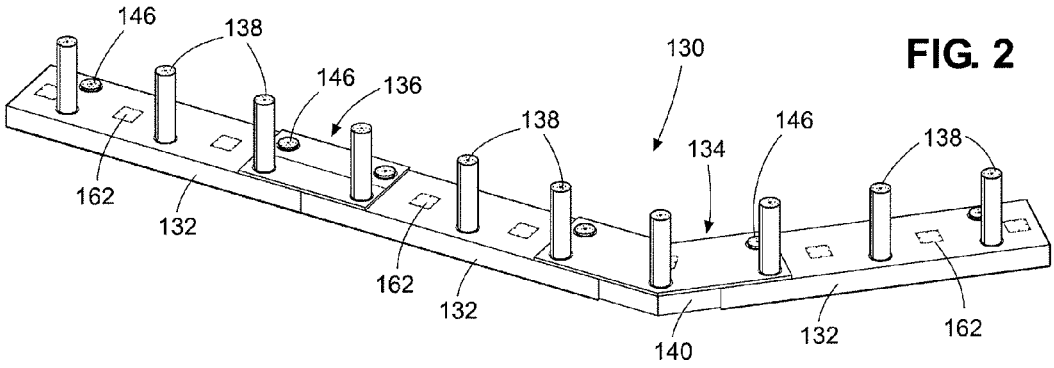
FIG. 2 is a perspective view of three interconnected bollard sections of a vehicle anti-ram system according to an embodiment of the invention.
Figure 3:
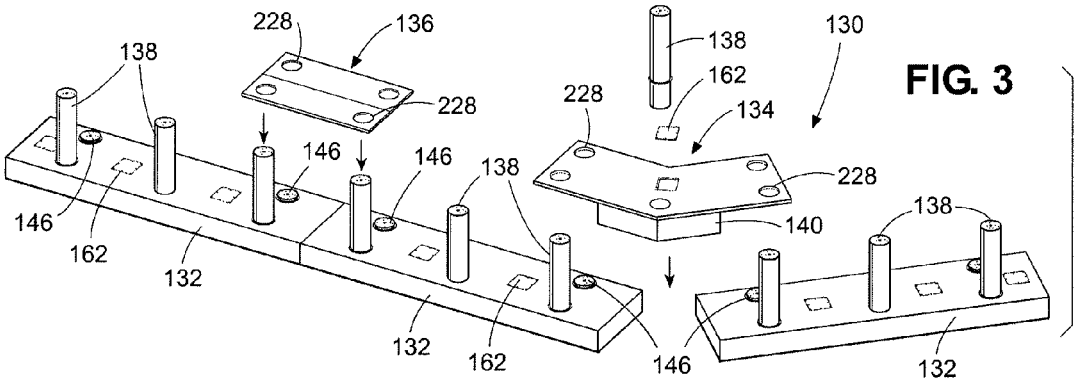
FIG. 3 is an exploded perspective view of the three bollard sections and connecting elements depicted in FIG. 2, with the connecting elements shown disconnected from the bollard sections.
Figure 12:
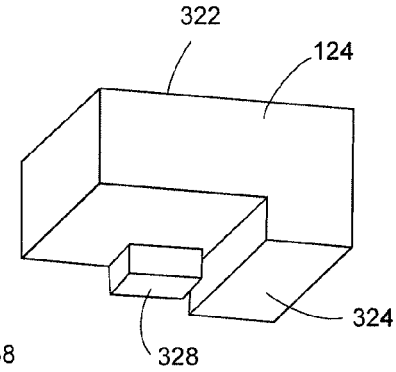
FIG. 12 is a perspective view of an anchor which is connected to an end of the anti-ram system depicted in FIG. 2.

The bollard system 130 depicted in FIGS. 2 and 3 comprises three bollard sections 132 and two connectors 134 and 136. FIGS. 2 and 3 do not depict a high friction mat 170 depicted in FIG. 5 or anchors depicted in other figures. Each bollard section 132 comprises a plurality of bollards 138. FIG. 12 depicts an anchor 140 for each end of the system, which is not depicted in FIGS. 2 and 3. Connector 134 connects two spaced bollard sections at an inside (opposite the side of expected impact) angle of 45°. Connector 134 includes a base 140 and a bollard 138. Connector 136 connects two abutted bollard sections along a straight angle and may comprise a single plate or two plates as shown.

Figure 4:
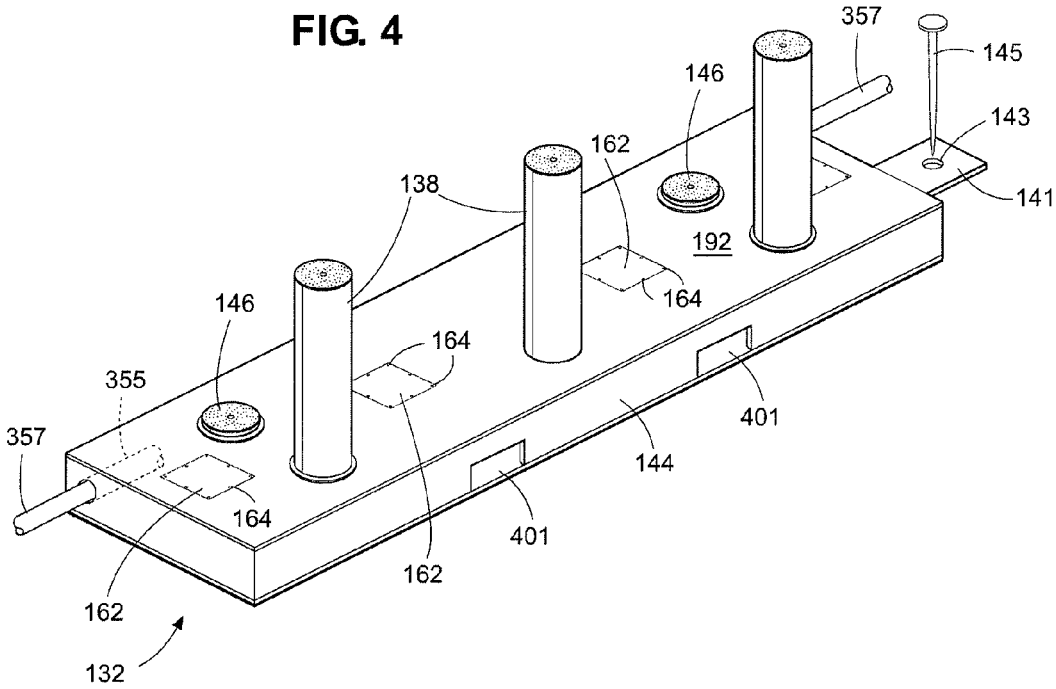
FIG. 4 is a perspective view of one of the bollard sections depicted in FIG. 2.
Figure 5:
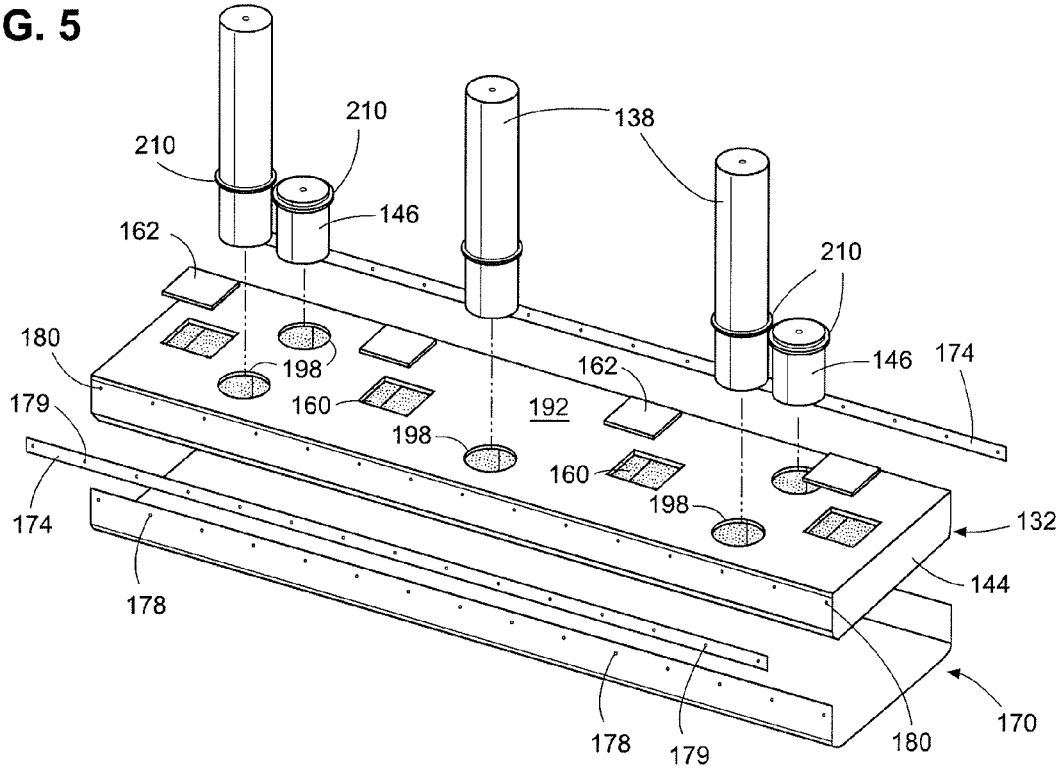
FIG. 5 is an exploded perspective view of the bollard section depicted in FIG. 4 and showing additional components.

Referring to FIGS. 4-7, each bollard section 132 comprises a base 144 to which the bollards 138 are attached and a tab or bollard stub 146 used with a connector 134 and 136 to interconnect adjacent bollard sections. Tabs 146 may be configured as shorter height bollards. A connector such as connector 136 engages a base at two spaced points, one point being the engagement of a bollard 138 with a hole 228 in the connector, and the other point being engagement of a stub 146 with a hole 228 in the connector. Engagement of a connector with a base via a bollard and another structure such as a tab, stub or key (FIG. 16), assists in stabilizing and strengthening connection of bollard sections. Each base is configured as a closed enclosure and may be filled with ballast through openings 160 (FIG. 5) closed by covers 162 (not shown in FIG. 6). The covers 162 can be attached to the base 144 by fasteners, e.g., screws 164 (FIG. 4). A high friction mat or pad 170 (FIG. 5) may be provided for each base 144. One way of securing the mat to the base is by folding ends of the mat upwardly along sides of the base, and attached the folded up ends of the mat to the base with straps 174 and fasteners, e.g., screws (not shown) in holes 178, 179, 180. One added benefit of using a rubber pad is that a system can be placed on a quality surface, such as expensive pavers, and then removed without damaging the surface or leaving marks. As depicted in FIG. 5, the bollards 138 and tabs 146 are removable.

Figure 6:
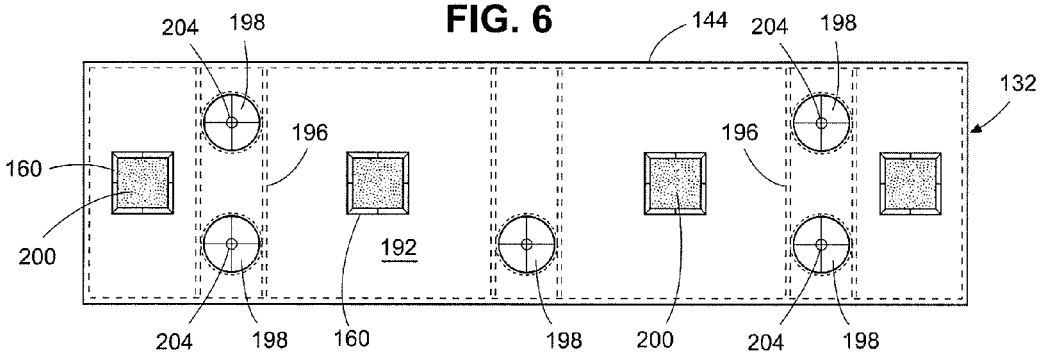
FIG. 6 is a top plan view of the bollard section depicted in FIG. 4 showing in broken lines internal gussets and sides of a bottom section.
Figure 7:
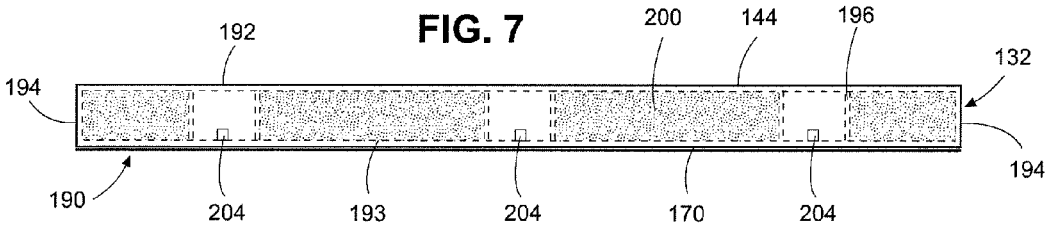
FIG. 7 is a side elevation view of the bollard section depicted in FIG. 4 showing in broken lines the internal gussets and sides of the bottom section also shown in FIG. 6 and a bolt secured to the bottom section for attaching a bollard.

Referring to FIGS. 6 and 7, a base 144 may comprise a bottom section 190 and a top 192. The bottom section 190 includes a bottom 193 and sides 194 and forms an enclosure for ballast 200, illustrated as speckled in FIGS. 6 and 7. The bottom section 190 may be formed in any suitable manner, e.g., from a plate by suitable bending and welding operations. The bottom section 190 also includes structural members in the form of gussets 196 extending from the front to the rear of the base and forming reinforced compartments within which the bollards and tabs are secured to the base. The gussets 196 also form compartments for ballast. A top 192 is secured to a bottom section in any suitable manner, e.g., by welding or fasteners. Bases made be constructed in any suitable manner and may include structural members for reinforcement or other purposes other than the gussets 196. The base 144 includes holes 198 through which bollards 138 and stubs 146 pass.

Figure 8:
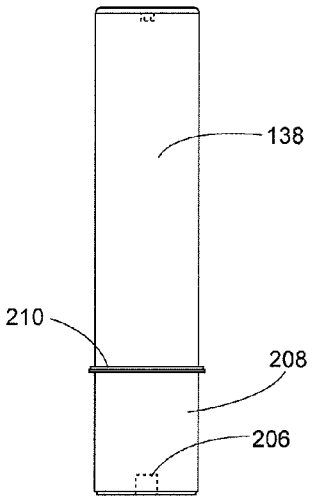
FIG. 8 is side elevation view of a bollard showing in broken lines engaging structure in the form of internal threading to mate with the bolt depicted in FIG. 7.

Referring to FIGS. 7 and 8, a bollard 138 may be secured to a base 144 with a fastener system comprising a threaded stud or bolt 204 attached to the base and a threaded bore or plug 206 in a solid section 208 of a bollard (FIG. 8). A ring 210 on the lower end of the bollard is positioned to function as a stop for the bollard to engage the top 192. A bollard 138 is inserted into the base through a hole 198 in the top 192 and threaded to a bolt 204 until the ring 210 engages the top 192. Alternatively, the bollards may be secured to the bottom section first and then the top secured to the bottom section with the ring engaging the top in the interior of the base. Bollards are hollow above the solid section 208 and are filled with a ballast such as concrete.

A bollard 138 is held to a base during impact by engagement with the top 192 through a hole 198 and securement to the base by a bolt 204. This is sufficient to transfer impact to the base by a bolt 204. This is sufficient to transfer impact to the base of the section. That base and the system it is connected to counteracts as described above.

Bollards may be made of any suitable material such as steel, e.g., 10" schedule 120 steel. Bollards may have any suitable height, for complying with DOS and are in some embodiments in the range of 36"-40".

A bollard 138 may be secured to connector 134 in a similar manner.

Tabs or stubs 146 may be installed in the same manner as bollards and may be made of the same or similar material. For example, a tab 146 may be identical to the solid section 208 of a bollard and sized to protrude from the top 192 a distance approximately equal to the thickness of a connector, e.g., about 2".

A base may be made of any material suitable for the application, e.g., steel, but other materials may be used. Various thicknesses may be used depending upon the application, e.g., 2" thick steel plate.

According to some embodiments, the width of a base is from about 3 feet to about 6 feet or more. According to some embodiments bollard placement is such as to be from about 3 feet to about 4 feet on-center (to comply with DOS ratings) apart relative to bollards on the base and a bollard on an adjacent interconnected base or connector. For example, a base may have a length of from about 6 feet and up depending upon portability and other factors. For example, the height of a base can be from about 4 inches to about 18 inches or more. In one exemplary embodiment, a base may be about 12" by about 4' by about 14'. A bollard section may weigh 20,000 lbs or more, or less, depending upon factors discussed herein. However, as mentioned, bases may be sized and bollard spacing and height selected for various applications and DOS or ASTM crash test ratings such as K4, K8, K12, etc.

According to some embodiments, a base comprises steel plates secured together to form an enclosure. According to some embodiments, a base comprises structural members, e.g., reinforcing or supporting, members such as gussets, channels, tubes, angles, beams, etc., secured to a plate or plates of the base. According to some embodiments, a base comprises a bottom section 192 including a bottom 193 and sides 194, and the structural members 196 are secured to the bottom and/or the sides. According to some embodiments, the structural members are welded to the bottom section. According to some embodiments, the structural members are attached to the bottom section by fasteners.

According to some embodiments, a base comprises the bottom section 192 and a top plate 192 secured to the bottom section to form a closed enclosure. According to some embodiments, the top is welded to the bottom section. According to some embodiments, the top is secured to the bottom section by fasteners. According to some embodiments, the top comprises one or more openings 160 for introducing ballast.

Figure 9:
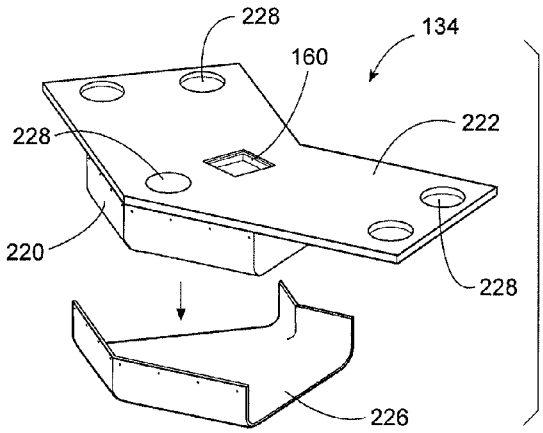
FIG. 9 is an exploded perspective view of an embodiment of a 45° connector for two bollard sections.

Connectors of various configurations may be used to interconnect bollard sections. FIGS. 9 and 10 depict examples. The connector 134 depicted in FIG. 9 connects two bollard sections 132 at a 45° inside angle, as depicted in FIGS. 2 and 3. The connector 134 comprises a bottom section 220 and a top 222. The bottom section 220 in one embodiment can be similar to the bottom section 190 of a base 144. For example, the bottom section 220 may include structural members defining a channel for a bollard 138 (not shown in FIG. 9) and a chamber or chambers to hold ballast. A high friction mat 226 may be provided for the connector, and secured by straps and fasteners as described above for mat 170. The top 222 also includes holes 228 for engaging bollards 138 and stubs 146 of bollard sections that the connector 134 interconnects, as depicted in FIGS. 2-3. The connector 134 also includes a hole 160 for introducing ballast, and a cover (not shown, but the same as cover 162) for the hole 160.

As mentioned, connectors may be provided to achieve various system configurations and to accommodate various features such as traversing a curb, providing a pedestrian passage, providing a vehicle passage, etc. In FIGS. 2 and 3, connector 136 comprises a single plate or two narrower plates with holes with holes 228 for bollards 138. Connector 136 provides a 180° connection of bollard sections 132.

Figure 10A:
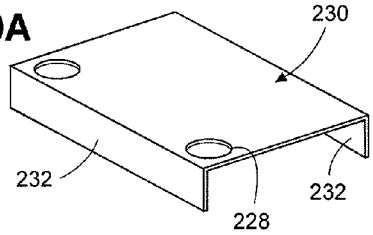
FIGS. 10A-10F are perspective views of connectors according to other embodiments of the invention.

FIG. 10A depicts another embodiment of a 180° connector 230 with sides 232 which fit over the sides 190 of the bases 144. Connector 230 includes only holes 228 for bollards and no holes for stubs 146.

Figure 10B:
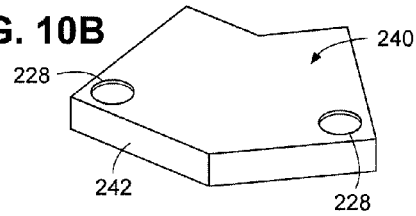

FIG. 10B depicts connector 240 with sides 242 which provides an inside 45° connection. Like connector 230, connector 240 includes only two holes 228 for bollards 138, and is intended for use with bollard sections without stubs 146.

Figure 10C:
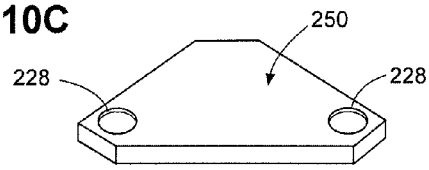

FIG. 10C depicts an embodiment of an outside 45° connector 250, which includes only two holes 228.

Figure 10D:
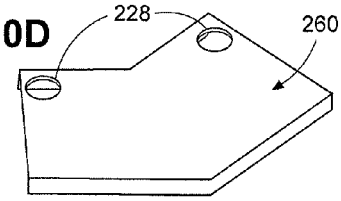

FIG. 10D depicts an embodiment of an inside 45° connector 260, which includes only two holes 228 for bollards and no sides.

Figure 10E:
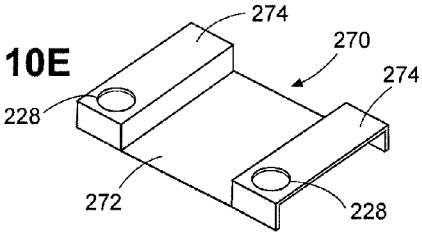

FIG. 10E depicts an embodiment of a 180° connector 270 that forms a passage for handicapped pedestrians using aids such as wheelchairs and walkers, etc., or for bicycles, carriages, etc. Bases such as base 144 are spaced to accommodate connector 270, which includes a lower portion 272 that rests on the street or sidewalk, etc., and raised portions 274 on each side of the lower portion 272 which each has a height slightly higher than the height of the adjacent base to fit thereover. Connector 270 includes holes 228 for bollards 138. The lower portion 272 eliminates a step otherwise presented by abutting bases.

Figure 10F:
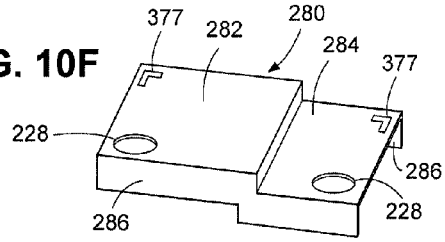

FIG. 10F depicts a connector 280 which transitions between a base on a sidewalk or higher elevation and a base at street level or a lower elevation. Connector 280 includes an upper portion 282 that attaches to the base at the higher elevation and a lower portion 284 that attaches to a base at a lower elevation. Connector 280 includes sides 286 and only two holes 228 for bollards.

Figure 11:
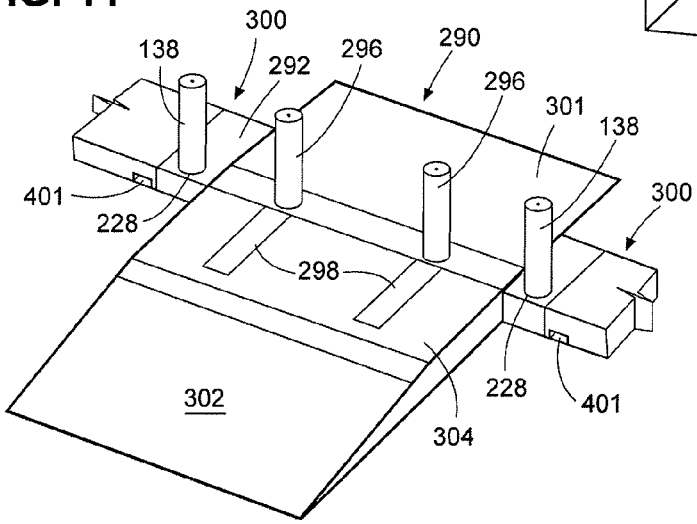
FIG. 11 is a perspective view of a portion of an anti-ram system including a vehicle pass-through according to an embodiment of the invention.

FIG. 11 depicts a connector 290 that also functions as a vehicle passage through an anti-ram system. Connector 290 is interconnected to spaced bollard sections 300, which are only partially shown. Attached to opposite sides of connector 290 are 180° connector parts 292, similar to 180° connector 230 (or connector 272). Connector parts 292 each include a hole 228 for a bollard and are connected to bases as described above. Other suitable structure may be provided for interconnecting connector 290 with adjacent bases.

Connector 290 comprises one or more retractable or removable bollards 296, which can be conventional. In the depicted embodiment, bollards 296 retract into channels referenced by 298. Connector 290 also comprises entrance and exit ramps 300, 301 which lead to an elevated central section 304 which is approximately the height of the adjacent bases, but could be higher or lower. The height of the central section in one embodiment is sufficient to accommodate channels 298 for the bollards. In use, the bollards are normally extended as shown in FIG. 11, and retracted when an authorized vehicle is to pass through the bollard system. The bollards can be retracted and extended manually or automatically (e.g., hydraulically), in accordance with the prior art.

As discussed above, embodiments of bollard systems may include an anchor or anchors at the ends of the system. (However, as also discussed above, not all embodiments include an anchor or anchors.) FIG. 12 depicts one embodiment of an anchor 134 in the form of a deadman which includes an upper portion 322 which is positioned on top of a base, and a lower portion 324 which is configured to extend over the end of the base and contact the surface supporting the base. The anchor 140 also includes a projection 328 projecting downwardly from the bottom of the upper portion 322. The projection 328 mates with similarly configured a hole in the base (not shown) to properly seat the anchor and to help hold the anchor in position. Instead of a hole in the base, a bracket (not shown) with a hole configured to mate with projection 328, may be provided to be attached to the top of the base positioned to receive the projection 328. Anchor 140 may be solid, e.g., made of concrete, or may be a hollow steel box having an opening on the top (or open at the top) through which ballast can be introduced. According to one embodiment, the anchor 134 has a width about the width of the base, and is a length about the spacing between bollards or larger and any suitable height.

Figure 13:
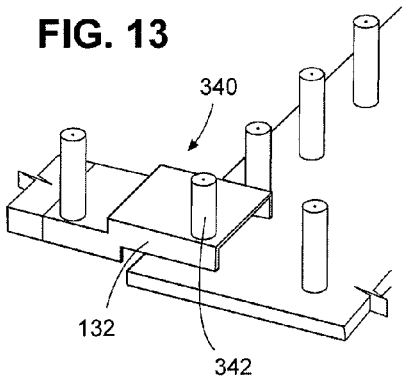
FIG. 13 is a perspective view of a connector also acting as a connector also acting as an anchor that can be attached to an end of permanently installed anti-ram system according to embodiments of the invention.
Figure 14:
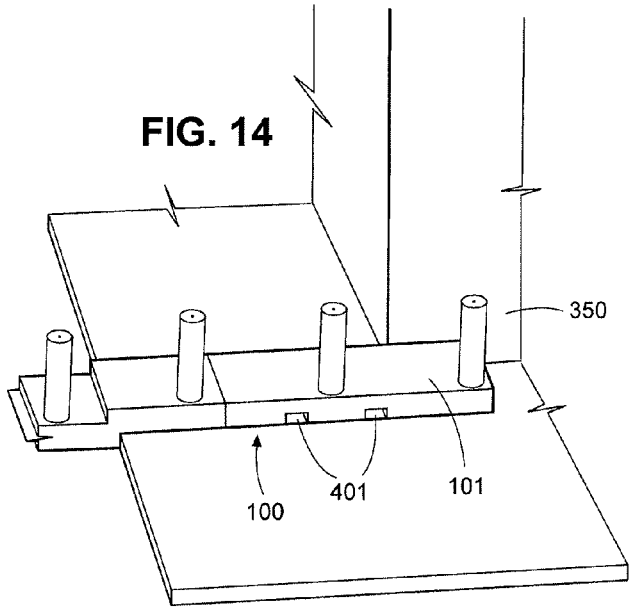
FIG. 14 is a perspective view of an end of an anti-ram system according to an embodiment of the invention engaged with a building as an anchor.
Figure 15:
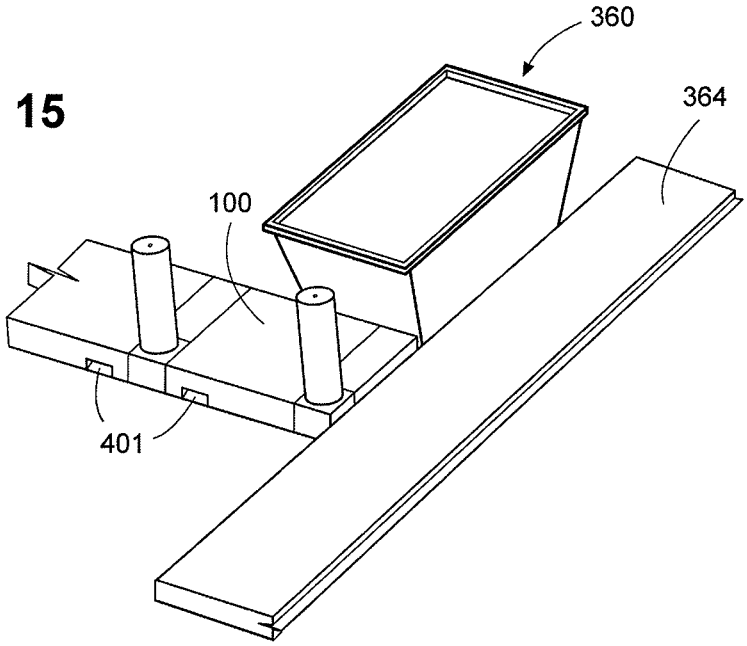
FIG. 15 is a perspective view of a part of an anti-ram system which includes an anchor in the form of a ballasted container engaged with an end of the system.

FIGS. 13-16 depict other embodiments of anchors. In FIG. 13, a connector 340, similar to connector 280, anchors bollard section 132, mounted on a street, to a permanent shallow or deep mount bollard 342 mounted on a sidewalk. In FIG. 14, an end 101 of the bollard system 100 extends along a portion of a building wall 350, which functions as an anchor. In FIG. 15, an anchor in the form of a container or deadman 360 filled with ballast abuts the end of a bollard system 100. As depicted, the anchor 360 also abuts a curb 364. According to one embodiment, approximate size of the container may be 6 ft x 6 ft x 10 ft, and the ballast may be sand.

As discussed above, anchors may also comprise spikes or rods or other structure which passes through a base and penetrates a paved or unpaved surface. According to one embodiment depicted in FIG. 4, a bracket 141 having a hole 143 is attached to base 132. A spike 145 passed through the hole 143 is driven into the ground and can function as an anchor.

As mentioned above, an anchor may comprise cabling and/or an anti-ram system may include a post-tensioned cable or cables. According to one embodiment depicted in FIG. 4, a conduit 355 extends lengthwise along a rear portion of a base which is suitably secured to the base such that a tightened or tensioned cable 357 passing through the base will resist movement of the base. A cable may be passed through one or more bases, and either anchored at either or both ends or connected to conventional post-tensioning structure. As mentioned, cabling either as or part of an anchor or as a post-tensioning system for one or more bollard sections can strengthen an anti-ram system and reduce the stopping distance.

Figure 16:
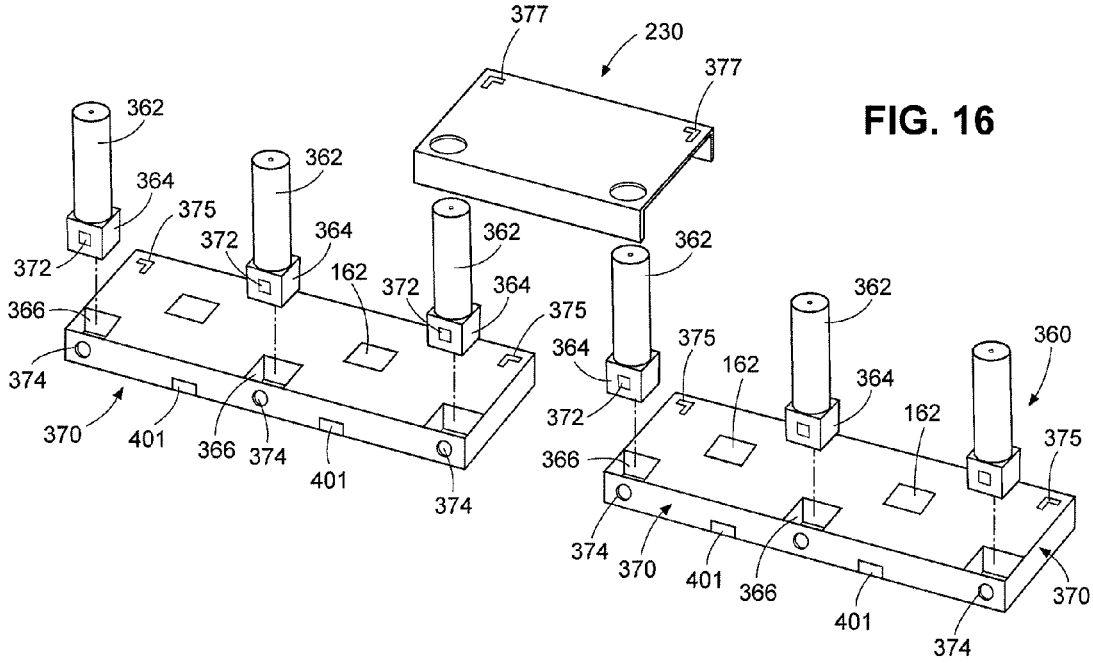
FIG. 16 is an exploded perspective view of two bollard sections and a connector of a vehicle anti-ram system according to another embodiment of the invention.
Figure 17:
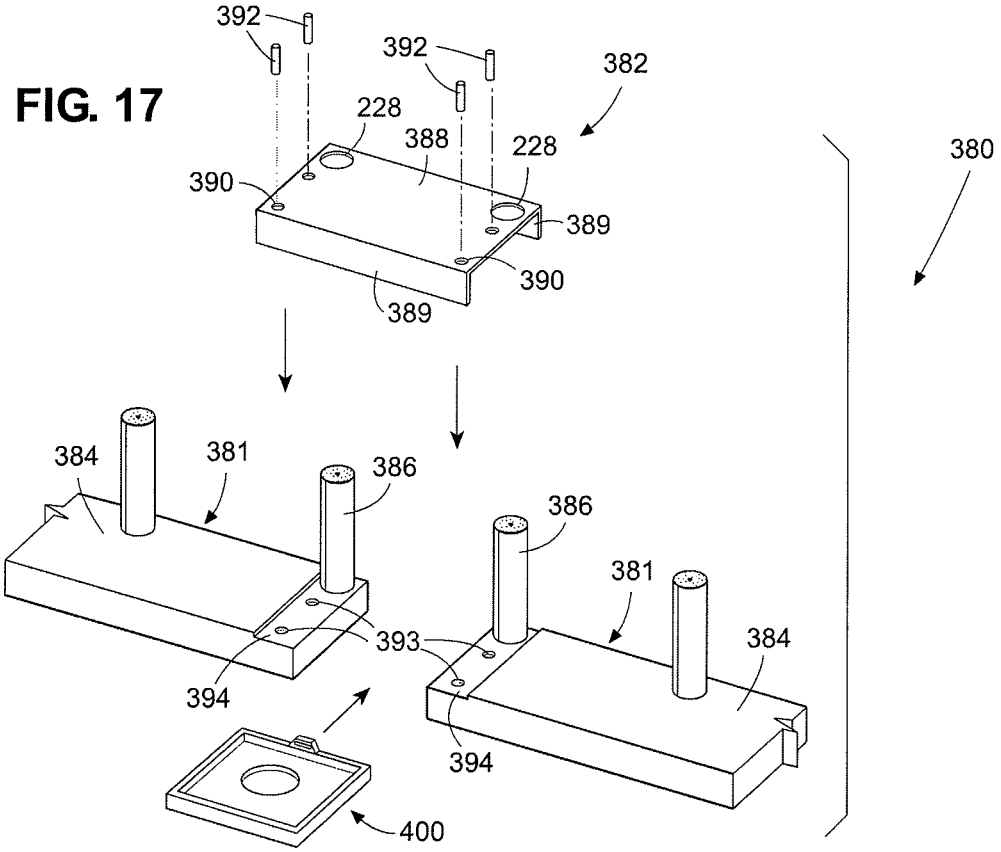
FIG. 17 is an exploded perspective view of portions of two bollard sections and a connector of a vehicle anti-ram system according to another embodiment of the invention.

FIGS. 16 and 17 depict other embodiments of bollard sections. Bollard section 360 in FIG. 16 comprise removable bollards 362 which each include a tapered, rectangular bottom section 364 which mates with a similarly configured channel or hole 366 in the base 370. The bottom section 364 includes a centrally positioned treaded bore or plug 372 which receives a bolt (not shown) passing through a hole 374 in the base to secure the bollard to the base. Except for the bottom section 364, bollards 362 can be similar to bollards 138. Securement is also provided by the mating structure 364, 366 of the bollard and the base. A connector such as connector 230 may be used to interconnect bases. A system of bollard sections 360 may include high friction mats and anchors (not shown) as described above.

Bases 370 of bollard sections 360 include a key 375 aligned with a bollard at each end of the base instead of a bollard stub 146. Correspondingly, connectors, e.g., connector 230, include a similarly configured keyway or hole 377 which mates with the key 374. This key/keyway structure stabilizes the connector at each base by virtue of engagement at two points, similar to engagement of a connector by a bollard and a stub (see FIG. 2, for example.)

In the embodiment depicted in FIG. 17, a system 380 of bollard sections 381 are interconnected by a connector 382 which is bolted to the bases 384. The bollards 386 may be constructed and installed as described for bollards 138. Connector 382 comprises a top plate 388 with sides 389, holes 390 for pins 392 and holes 228 for the bollards. The bollard sections 381 each include holes 393 for pins 392, and a bollard 386 secured to the end 394 thereof. Therefore, the bases can be spaced to achieve a desired spacing between the end bollards. During installation, this spacing can be provided by a spacer 400, which can be removed (or can remain) after the bollard sections have been positioned. (Spacers are discussed below in connection with FIGS. 18A-18C.) Then the connector 382 is installed. The top plate is positioned on the bases with the end bollards passing through the bollard holes 228 in the top plate, and the holes 390 aligned with holes 393 in the ends of the bases 384. The pins 392 are inserted through the holes 390 in the top plate into the holes 393 in the bases. The ends 394 of the bollard sections are recessed to receive the top plate 388 flush with the top of the base. Ends of the bollard sections 381 may be constructed as described above to cooperate with an anchor, or to be interconnected with other bollard sections. A system 380 of bollard sections 381 may include high friction mats and anchors (not shown) as described above.

Anti-ram systems according to embodiments of the invention may be installed in any suitable manner. Generally, a base is positioned and then ballasted if applicable. Then a spacer or spacers are positioned, if used. Then a connector is positioned. Then bollards and stubs are installed, although bollards not engaged by a connector can be installed before the connector is positioned. According to some embodiments, no welding or bolting is required, although if the system is to be made permanent or semi-permanent, for example, the components can be welded together. A system not installed using welding or bolting can be disassembled for re-use rapidly. In embodiments utilizing modular components, assembly and disassembly are simplified because, for example, similar components are interchangeable, and spacing and angle configuration, etc. can be achieving using a range of connectors. Also, modular systems can more easily be reconfigured.

One embodiment of an installation procedure is described below. To facilitate transporting and installing bollard sections, channels for entry of forklift arms are provided, e.g., channels 401 depicted in FIGS. 4, 11 and 14-16.

Figure 18A:
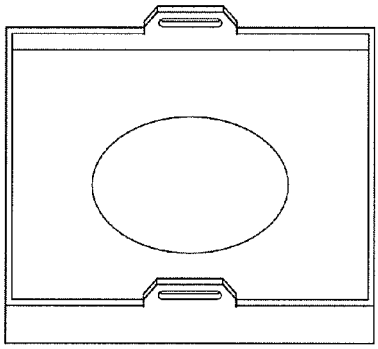
FIGS. 18A-18C are perspective views of spacers according to embodiments of the invention that can be used during installation of an anti-ram system according to embodiments of the invention.
Figure 18B:
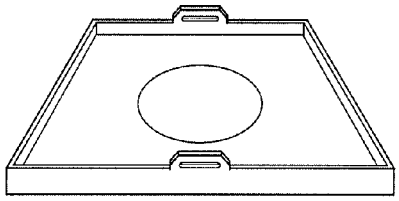
Figure 18D:
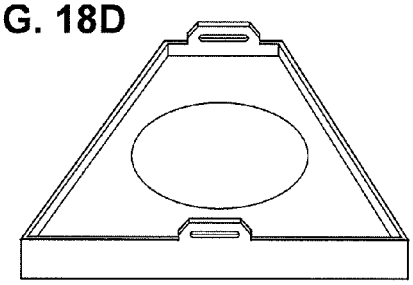
Figure 18C:
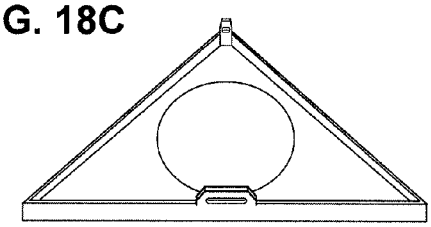

The bollard sections are positioned into the desired configuration of an anti-ram system using forklift trucks and spacers such as those depicted in FIGS. 18A-18C. FIG. 18A depicts a spacer for a 180° connector. FIG. 18B depicts a spacer for an inside 45° connector. FIG. 18C depicts a spacer for an outside 45° connector. FIG. 18D depicts a spacer for a 90° connector.

A first bollard section is fork-lifted into position along the line of the anti-ram system positioned with the bollard side of the section (which is the side on which the bollards are closest to a side (front) of the section facing the threat. For bollard sections that are to be ballasted, sand or other ballast in introduced into the base and the ballast holes covered.

A second bollard section fork-lifted into position abutting an end of the first bollard section and filled with ballast. (Spacers are not used where a connector such as connector 136 or 230 is used. However, for other connectors, the second bollard section is positioned spaced from the first bollard section by an appropriate spacer.)

For the first bollard section, install the center bollard (without the lower ring or band) by inserting the bollard into the forward hole in the base. The bolt securing the bollard to the base is tightened.

For a straight angle connection, the connector plate 230 or the connector plates 136 plates are fork-lifted into position over the forward and rear holes in the bases of the first and second bollard sections for the bollards and stubs. The front bollards (with the rings) are installed through the forward holes and the stubs (also with rings) installed through the rear holes and thorough the holes in the connector plate(s). The bolts securing the bollards and stubs to the bases are tightened.

The center bollard for the second bollard section is installed as described for the center bollard of the first bollard section.

Forklift a third section into position abutting and flush with the second bollard section and fill with ballast. Forklift the connector plate(s) for another 180° connector and position it over the forward and rear holes of the second and third bollard sections.

Install a bollard and a stub in each end of the second and third bollard sections, and tighten the securing bolts. Install the center bollard.

Continue sequence until all of the bollard sections are installed.

According to some embodiments, since excavation and site preparation is not needed generally needed, a 65' modular anti-ram system can be deployed in as little as about one hour, e.g., using a single fork lift truck or small crane and, e.g., with one or two personnel. Typically, not more than a preliminary review of the site is required since what lies below the system is typically not a concern. Anti-ram systems requiring excavation or substantial site preparation may take days or weeks to be installed depending on what is underground, construction and traffic permits, etc. Also, where excavation is required, additional time and resources are typically needed to remove and dispose of concrete, debris and soil.

An additional application of embodiments of the invention is as temporary vehicle barriers such as so-called Jersey Barriers or K-rails. These barriers are intended to be used parallel with the roadway to guide errant vehicles back in a lane, but not to stop vehicles at a 90° strike. For impacts, such barriers would tend simply to slide and have no or little real anti-ram capabilities. Although such barriers may have been used soon after 9-11, there use was based mainly on availability. Embodiments of surface mount anti-ram systems disclosed herein can be used in many if not all of such lane barrier applications.

Embodiments of the disclosed invention have been described and illustrated in an exemplary and non-limiting sense, and are not to be limited to the precise details of methodology or construction set forth above. For example, variations and modifications of bollard sections, bases, bollards, connectors, high friction mats, anchors, etc. will be evident to those skilled in the relevant arts from the disclosure herein and are intended to be encompassed by the disclosure.

We claim:

1. An anti-ram system comprising:

a plurality of bollard sections adapted to be connected together extending along a line or lines, each section comprising a base and a plurality of bollards secured to the base;

one or more connectors, each connecting two bollard sections together at adjacent ends thereof along a line; and at least one anchor adapted to engage at least one of the plurality of bollard sections when connected together so as to resist movement of the at least one bollard section if impacted;

wherein each base comprises a bottom, sides and a top secured together to define an enclosure of limited height which is adapted to hold ballast, each bollard of the plurality of bollards of a section extending upwardly from a respective base, and wherein each base comprises one or more opening for ballast to be introduced therein.

2. The ant-ram system of claim 1, wherein enclosure of ea it of the plurality of bollards is adapted to be installed on an unexcavated surface, and wherein the bollard sections and the at least one anchor comprise sufficient weight and the connector or connectors which are adapted to connect bollard sections together are such that connected bollard sections installed on unexcavated surface resist movement of any of the connected bollard sections after impact therewith.

3. The anti-ram system of claim 1, comprising high friction structure secured to a base of one or more of the plurality of bollard sections extending along the bottom thereof exterior to the enclosure thereof.

4. The anti-ram system of claim 1, wherein at least one anchor comprises a deadweight adapted to engage a bollard section.

5. The anti-ram system of claim 1, wherein at least one anchor comprises a man-made structure anchored to or adapted to be anchored to the ground and which a bollard section is adapted to engage.

6. The anti-ram system of claim 1, wherein at least one anchor comprises a naturally-occurring structure anchored to the ground and which a bollard section is adapted to engage.

7. The anti-ram system of claim 1, wherein at least one connector is adapted to engage at least one bollard of an adjacent bollard section.

8. The anti-ram system of claim 7, wherein the adjacent bollard section includes structure projecting from the top thereof spaced from the at least one bollard to be engaged, and wherein the at least one connector includes a receptacle adapted to be aligned with and engage the projecting structure.

9. The anti-ram system of claim 8, wherein the projecting structure comprises a bollard stub secured to the base of the adjacent bollard section.

10. The anti-ram system of claim 8, wherein the projecting structure comprises key configured structure and the receptacle comprises a keyway that mates with the key configured structure.

11. The anti-ram system of claim 1, wherein at least one of the connectors comprises a 180° connector including a top adapted to extend over ends of two adjacent bollard sections.

12. The anti-ram system of claim 1, wherein at least one of the connectors comprises a 45° connector including a top adapted to extend over ends of two adjacent bollard sections.

13. The anti-ram system of claim 12, wherein the at least one connector comprises sides and a bottom which with a portion of the top define an enclosure, the enclosure of the 45° connector being adapted to be positioned in a space between the two adjacent bollard sections with portions of the top extending beyond the enclosure of the 45° connector and over the ends of the two adjacent bollard sections.

14. The anti-ram system of claim 13, comprising at least one opening into the enclosure of the connector through which ballast can be introduced therein.

15. The anti-ram system of claim 13, comprising a bollard secured to the at least one connector, this bollard extending from the connector enclosure upwardly from the bottom thereof through a hole in the top thereof.

16. The anti-ram system of claim 1, wherein at least one of the connectors comprises an 180° connector including a central lower portion and raised portions on each side of the central portion, the raised portions being adapted to extend over be connected to ends of two adjacent bollard sections, the connector defining a lower region between the two adjacent bollard sections.

17. The anti-ram system of claim 1, wherein at least one of the connectors comprises an 180° connector including a lower portion and a raised portion, the raised portion being adapted to over and be connected to one of two adjacent bollard sections whose top is at higher elevation than the top of another of the two adjacent bollard sections, and the lower portion being adapted to extend over and be connected to the bollard section whose top is at an elevation lower than that of the one bollard section.

18. The anti-ram system claim 1, wherein at least one of the connectors comprises a vehicle passage comprising at least one retractable or removable bollard, the connector being adapted to be positioned between and be connected to ends of the two adjacent bollard sections.

19. The anti-ram system of claim 1. wherein at least one of the connectors comprises a bollard secured thereto, the connector being adapted to be positioned between and be connected to ends of two adjacent bollard sections.

20. The anti-ram system of claim 1, wherein the enclosure comprises a fiat bottom and a flat top.

21. The anti-ram system of claim 1, wherein the enclosure has a height in the approximate range of 4" to 18".

* * * * *